US005382500A

United States Patent [19]

Sugita et al.

[11] Patent Number: 5,382,500

[45] Date of Patent: Jan. 17, 1995

[54] SILVER HALIDE COLOR PHOTOGRAPHIC LIGHT-SENSITIVE MATERIAL

[75] Inventors: Shuichi Sugita; Hidenobu Ohya; Masakazu Tonishi, all of Hino, Japan

[73] Assignee: Konica Corporation, Japan

[21] Appl. No.: 173,787

[22] Filed: Dec. 27, 1993

[30] Foreign Application Priority Data

Feb. 5, 1993 [JP] Japan ..... 5-018954

[51] Int. Cl.[6] ..... G03C 1/46

[52] U.S. Cl. ..... 430/505; 430/503; 430/558; 430/546; 430/551

[58] Field of Search ..... 430/546, 551, 372, 387, 430/389, 558, 505, 503

[56] References Cited

U.S. PATENT DOCUMENTS

| | | | |
|---|---|---|---|
| 4,898,811 | 2/1990 | Wolff et al. | 430/546 |
| 4,973,535 | 11/1990 | Merkel et al. | 430/546 |
| 5,120,636 | 6/1992 | Takahashi et al. | 430/546 |

FOREIGN PATENT DOCUMENTS

| | | |
|---|---|---|
| 309159 | 3/1989 | European Pat. Off. . |
| 320776 | 6/1989 | European Pat. Off. . |
| 399541 | 11/1990 | European Pat. Off. . |
| 422595 | 4/1991 | European Pat. Off. . |
| 428899 | 5/1991 | European Pat. Off. . |
| 480292 | 4/1992 | European Pat. Off. . |
| 147009 | 3/1981 | Germany . |
| 62-79451 | 4/1987 | Japan . |
| 63-296045 | 12/1988 | Japan . |

*Primary Examiner*—Charles L. Bowers, Jr.
*Assistant Examiner*—Geraldine Letscher
*Attorney, Agent, or Firm*—Jordan B. Bierman

[57] ABSTRACT

Disclosed is a silver halide color photographic light-sensitive material comprising a support and thereon a blue-sensitive silver halide emulsion layer, a green-sensitive silver emulsion layer and a red-sensitive silver halide emulsion layer, wherein said green-sensitive emulsion layer contains at least one coupler represented by Formula M-I and at least one of a non-color-forming compound represented by Formula A-1 or A-2:

Formula (M-I)

wherein R represents a hydrogen atom or a substituent; X represents a hydrogen atom or a substituent capable of splitting upon making a reaction with an oxidized product of a color developing agent; and Z represents a group consisting of metal atoms necessary to form a nitrogen-containing heterocyclic ring:

Formula (A-1)

$R_{21}—NHSO_2—R_{22}$ wherein $R_{21}$ and $R_{22}$ represent each a hydrogen atom, an alkyl group, a cycloalkyl group, an alkenyl group, a cycloalkenyl group, an alkinyl group, an aryl group, a heterocyclic group, an alkoxy group, an aryloxy group, a heterocyclicoxy group, or wherein $R_{23}$ and $R_{24}$ represent each a hydrogen atom, an alkyl group or an aryl group:

Formula (A-2)

wherein $R_{31}$ represents an alkyl group, an alkoxycarbonyl group, an alkylsulfonyl group, an arylsulfonyl group, an arylsulfonylamino group or an alkylsulfonylamino group, an amino group or an alkylthio group; $R_{32}$ represents a group substitutable to a benzene ring; and $m_{31}$ is an integer of 1 to 4.

2 Claims, No Drawings

SILVER HALIDE COLOR PHOTOGRAPHIC LIGHT-SENSITIVE MATERIAL

FIELD OF THE INVENTION

This invention relates to a silver halide color photographic light-sensitive material and, particularly, to a silver halide color photographic light-sensitive material having a high sensitivity, an excellent processing variation resistance and an excellent raw-stock preservability.

BACKGROUND OF THE INVENTION

A silver halide color photographic light-sensitive material has usually contained each of yellow, magenta and cyan couplers in combination. Among the couplers, a 5-pyrazolone type magenta coupler has widely been used for the magenta coupler. The 5-pyrazolone type magenta couplers have had various color-reproduction problems, because a dye produced in a development has had a side absorption around 430 nm. For solving the problems, a novel magenta coupler has been researched so far. For example, such a pyrazolotriazole type coupler as disclosed in U.S. Pat. Nos. 3,725,065, 3,810,761, 3,758,309 and 3,725,067 have been developed.

The above-mentioned couplers have had many advantages such as that few side absorption may be produced, that a color reproduction may advantageously be displayed and that a preservability may be excellent in the presence of formalin.

However, the pyrazolotriazole type couplers have been relatively lower in sensitivity as compared to any conventional 5-pyrazolone type magenta couplers, because those particular type magenta couplers have had an inhibition property in themselves. It has also become apparent that they have raised such a problem that the sensitivity thereof has been lowered in the course of preserving a coated sample at a high temperature and high humidity.

It has further come out that the pyrazolotriazole type couplers have raised such a problem that they have had a relatively lower processing variation resistance as compared to any conventional 5-pyrazolone type coupler and, inter alia, that they have produced a particularly serious pH variation.

For a silver halide color photographic light-sensitive material containing a pyrazolotriazole type magenta coupler, it has therefore been demanded to provide a technique not only for making a sensitivity higher and making a preservability excellent, but also for reducing a processing variation including particularly a pH variation.

SUMMARY OF THE INVENTION

It is, therefore, an object of the invention to provide a silver halide color photographic light-sensitive material not only high in sensitivity, excellent in processing variation resistance, but also excellent in raw stock preservability.

The above-mentioned object of the invention can be achieved with a silver halide color photographic light-sensitive material comprising a support bearing a photographic component layer including a blue-sensitive silver halide emulsion layer, a green-sensitive silver halide emulsion layer and a red-sensitive silver halide emulsion layer; wherein at least one of said green-sensitive silver halide emulsion layers contains at least one kind of a coupler represented by the following Formula (M-I) and at least one kind of a non-color-developable compound represented by the following Formula (A-1) or (A-2).

Formula (M-I)

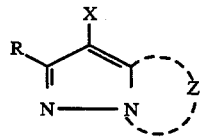

wherein R represents a hydrogen atom or a substituent; X represents a hydrogen atom or a substituent capable of splitting upon making a reaction with an oxidized product of a color developing agent; and Z represents a group consisting of metal atoms necessary to form a nitrogen-containing heterocyclic ring.

Formula (A-1)

$R_{21}$—$NHSO_2$—$R_{22}$ wherein $R_{21}$ and $R_{22}$ represent each a hydrogen atom, an alkyl group, a cycloalkyl group, an alkenyl group, a cycloalkenyl group, an alkinyl group, an aryl group, a heterocyclic group, an alkoxy group, an aryloxy group, a heterocyclic-oxy group, or

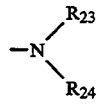

wherein $R_{23}$ and $R_{24}$ represent each a hydrogen atom, an alkyl group or an aryl group.

Formula (A-2)

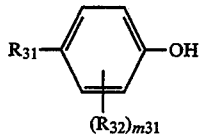

wherein $R_{31}$ represents an alkyl group, an alkoxycarbonyl group, an alkylsulfonyl group, an arylsulfonyl group, an arylsulfonylamino group or an alkylsulfonylamino group, an amino group or an alkylthio group; $R_{32}$ represents a group substitutable to a benzene ring; and $m_{31}$ is an integer of 1 to 4.

DETAILED DESCRIPTION OF THE INVENTION

A magenta coupler relating to the invention, represented by the foregoing Formula (M-I) will now be detailed.

Formula (M-I)

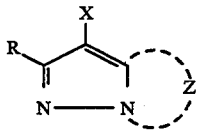

wherein Z represents a group consisting of metal atoms necessary to form a nitrogen-containing heterocyclic group, provided that the ring formed by Z may have a substituent; X represents a hydrogen atom or a group capable of splitting off upon making reaction with an oxidized product of a color developing agent; and R represents a hydrogen atom or a substituent.

There is no special limitation to the substituents represented by R. However, they include, typically, each group of alkyl, aryl, anilino, acylamino, sulfonamido, alkylthio, arylthio, alkenyl and cycloalkyl. Besides the above, they also include, for example, a halogen atom, each group of cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic-thio, a spiro compound residual group and a cross-linked hydrocarbon compound residual group.

The alkyl groups represented by R include, preferably, those each having 1 to 32 carbon atoms and they may be straight-chained or branched.

The aryl groups represented by R include, preferably, a phenyl group.

The acylamino groups represented by R include, for example, an alkylcarbonylamino group and an arylcarbonylamino group.

The sulfonamido groups represented by R include, for example, an alkylsulfonylamino group and an arylsulfonylamino group.

The alkyl components and aryl components of the alkylthio group and arylthio group each represented by R include, for example, an alkyl group and an aryl group each represented by the above-denoted R.

The alkenyl groups represented by R include, for example, those each having 2 to 32 carbon atoms. The cycloalkyl groups represented by R include, for example those each having 3 to 32 carbon atoms and, preferably, 5 to 7 carbon atoms. Such an alkenyl group as mentioned above may be straight-chained or branched.

The cycloalkenyl groups represented by R include, for example, those each having 3 to 12 carbon atoms and, particularly, 5 to 7 carbon atoms;

The sulfonyl groups represented by R include, for example, an alkylsulfonyl group and an arylsulfonyl group;

The sulfinyl groups represented by R include, for example, an alkylsulfinyl group and an aryl sulfinyl group;

The phosphonyl groups include, for example, an alkylphosphonyl group, an alkoxyphosphonyl group, an aryloxyphosphonyl group and an arylphosphonyl group;

The acyl groups include, for example, an alkylcarbonyl group and an arylcarbonyl group;

The carbamoyl groups include, for example, an alkylcarbamoyl group and an arylcarbamoyl group;

The sulfamoyl groups include, for example, an alkylsulfamoyl group and an arylsulfamoyl group;

The acyloxy groups include, for example, an alkylcarbonyloxy group and an arylcarbonyloxy group;

The carbamoyloxy groups include, for example, an alkylcarbamoyloxy group and an arylcarbamoyloxy group;

The ureido groups include, for example, an alkylureido group and an arylureido group;

The sulfamoylamino groups include, for example, an alkylsulfamoylamino group and an arylsulfamoylamino group;

The heterocyclic groups include, preferably, those each having 5 to 7 carbon atoms including, typically, a 2-furyl group, a 2-thienyl group, a 2-pyrimidinyl group and a 2-benzothiazolyl group;

The heterocyclic-oxy groups include, preferably, those each having a 5- to 7-membered heterocyclic ring including, typically, a 3,4,5,6-tetrahydropyranyl-2-oxy group and a 1-phenyltetrazole-5-oxy group;

The heterocyclic thio groups include, preferably, a 5 to 7-membered heterocyclic thio group including, typically, a 2-pyridylthio group, a 2-benzothiazolylthio group and a 2,4-diphenoxy-1,3,5-triazole-6-thio group;

The siloxy groups include, for example, a trimethylsiloxy group, a triethylsiloxy group and a dimethylbutylsiloxy group;

The imido groups include, for example, a succinimido group, a 3-heptadecyl succinimido group, a phthalimido group and a glutarimido group;

The spito-compound residual groups include, for example, spiro[3.3]heptane-1-yl; and The cross-linked hydrocarbon compound residual groups include, for example, bicyclo[2.2.1]heptane-1-yl, tricyclo [3.3.1.1$^{3,7}$] decane-1-yl and 7,7-dimethylbicyclo[2.2.1]heptane-1-yl; respectively.

The groups represented by X capable of splitting off upon making reaction with an oxidized product of a color developing agent include, for example, a halogen atom (such as a chlorine atom, a bromine atom and a fluorine atom) and each of the groups of alkoxy, aryloxy, heterocyclic-oxy, acyloxy, sulfonyloxy, alkoxycarbonyloxy, aryloxycarbonyloxy, alkyloxalyloxy, alkoxyoxalyloxy, alkylthio, aryl thio, heterocyclic-thio, alkyloxythiocarbonylthio, acylamino, sulfonamido, nitrogen-containing heterocyclic ring coupled with N atom, alkyloxycarbonylamino, aryloxycarbonylamino, carboxyl, and

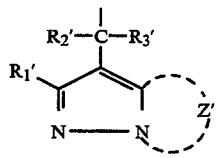

wherein $R_1'$ is synonymous with the foregoing R; Z' is synonymous with the foregoing Z; and $R_2'$ and $R_3'$ represent each a hydrogen atom, an aryl group, an alkyl group or a heterocyclic group. Among them, a halogen atom is preferable and, particularly, a chlorine atom.

The nitrogen-containing heterocyclic rings formed of Z or Z' include, for example, a pyrazole ring, an imidazole ring, a triazole ring or a tetrazole ring. The substituents allowed to be attached thereto include, for example, those given in the descriptions of the foregoing R.

Those represented by Formula (M-I) may further represented typically by the following Formulas (M-II) through (M-VII).

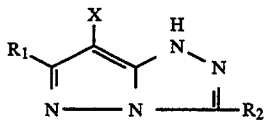

Formula (M-II)

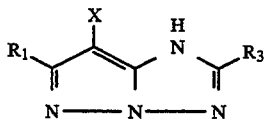

Formula (M-III)

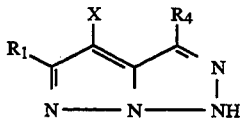

Formula (M-IV)

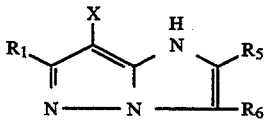

Formula (M-V)

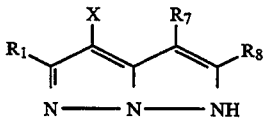

Formula (M-VI)

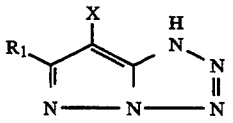

Formula (M-VII)

In the above-given Formulas (M-II) through (M-VII), $R_1$ through $R_8$ and X are synonymous with the foregoing R and X, respectively.

The couplers represented by Formula (M-I) include, preferably, those represented by the following Formula (M-VIII).

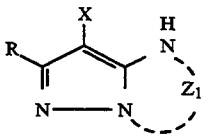

Formula (M-VIII)

The couplers represented by Formula (M-II) include, preferably, those represented by the following Formulas (M-IX) through (M-XII).

In Formula (M-IX), $R_9$ represents a primary alkyl group having not less than 2 carbon atoms in the aggregate; and $R_{10}$ represents a substituent. The primary alkyl groups represented by $R_9$ each having not less than 2 carbon atoms in the aggregate include, typically, an ethyl group, a n-propyl group, a n-butyl group, a n-pentyl group, a n-hexyl group, a n-undecyl group, a n-dodecyl group, a n-pentadecyl group and a n-heptadecyl group and, among them, a straight-chained unsubstituted alkyl group having 11 to 17 carbon atoms in the aggregate is particularly preferable. The substituents represented by $R_{10}$ include, for example, those described of R denoted in Formula (M-I).

In Formula (M-X), $R_{11}$ is synonymous with R denoted in Formula (M-I); and $R_{12}$ represents a secondary or tertiary branched alkyl group. Those represented by $R_{11}$ include, preferably an alkyl group, more preferably a methyl group, an i-propyl group and a t-butyl group and, most preferably a methyl group.

In Formula (M-XI), $R_{13}$ represents a tertiary alkyl group; and $R_{14}$ represents a substituent. $R_{13}$ represents preferably a t-butyl group. The substituents represented by $R_{14}$ include those described of R denoted in Formula (M-I).

In Formula (M-XII), $R_{15}$ is synonymous with R denoted in Formula (M-I); and $R_{16}$ represents an aryl group. Those represented by $R_{15}$ include, preferably a methyl group, an i-propyl group, a t-butyl group and most preferably a methyl group. The aryl groups represented by $R_{16}$ include preferably a phenyl group and, more preferably an o-substituted phenyl group. The substituents of o- include, preferably, an alkyl group, an alkyloxy group, an amino group, an alkylthio group, an alkylsulfonyl group, an acylamino group, a sulfonylamino group and a halogen atom.

Among the couplers represented by Formula (M-II), the preferable couplers are represented by (M-IX), (M-X) and (M-XII).

In the formula, $R_1'$, X and $Z_1$ are synonymous with R, X and Z denoted in Formula (M-I).

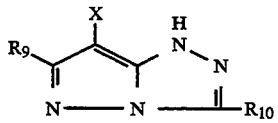

Formula (M-IX)

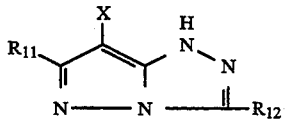

Formula (M-X)

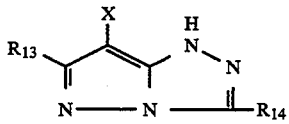

Formula (M-XI)

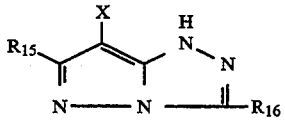

Formula (M-XII)

Some of the exemplified compounds of the invention represented by Formula (M-I) will be given below.

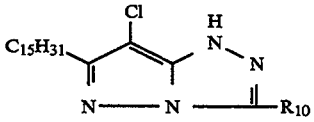

| No. | $R_{10}$ |
|---|---|

-continued

| | |
|---|---|
| MC-1 | $-CH_2CH_2SO_2CH_2CH(C_8H_{17})(C_6H_{13})$ |
| MC-2 | $-CH_2CH_2SO_2C_{12}H_{25}$ |
| MC-3 | $-CH_2CH_2SO_2C_{16}H_{33}$ |
| MC-4 | $-CH_2CH_2SO_2C_{18}H_{37}$ |
| MC-5 | $-CH(CH_3)CH_2SO_2C_{12}H_{25}$ |
| MC-6 | $-CH(CH_3)CH_2SO_2C_{16}H_{33}$ |
| MC-7 | $-CH_2CH_2CH_2SO_2C_{12}H_{25}$ |
| MC-8 | $-CH_2CH_2CH_2SO_2C_{16}H_{33}$ |
| MC-9 | $-C(CH_3)_2-CH_2SO_2C_{18}H_{37}$ |
| MC-10 | $-C(CH_3)_2-CH_2SO_2CH_2CH_2COOH$ |
| MC-11 | $-C(CH_3)_2-CH_2SO_2-C_6H_4-COOH$ |
| MC-12 | $-CH_2CH_2SO_2CH_2CH(C_2H_5)C_4H_9$ |

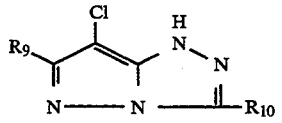

| No. | $R_9$ | $R_{10}$ |
|---|---|---|
| MC-13 | $C_2H_5$ | $-CH_2CH_2SO_2CH_2CH(C_8H_{17})(C_6H_{13})$ |
| MC-14 | $C_2H_5$ | $-CH_2CH_2SO_2C_{12}H_{25}$ |
| MC-15 | $C_2H_5$ | $-CH_2CH_2CH_2SO_2C_{12}H_{25}$ |
| MC-16 | $C_2H_5$ | $-CH(CH_3)CH_2SO_2C_{12}H_{25}$ |
| MC-17 | $C_3H_7$ | $-CH_2CH_2SO_2CH_2CH(C_8H_{17})(C_6H_{13})$ |
| MC-18 | $C_5H_{11}$ | $-CH_2CH_2SO_2CH_2CH(C_8H_{17})(C_6H_{13})$ |
| MC-19 | $C_{11}H_{23}$ | $-CH_2CH_2SO_2CH_2CH(C_8H_{17})(C_6H_{13})$ |

-continued

| | | |
|---|---|---|
| MC-20 | $C_{11}H_{23}$ | $-CH_2CH_2SO_2C_{12}H_{25}$ |
| MC-21 | $C_{11}H_{23}$ | $-CH_2CH_2SO_2C_{16}H_{33}$ |
| MC-22 | $C_{11}H_{23}$ | $-CH_2CH_2CH_2SO_2C_{12}H_{25}$ |
| MC-23 | $C_{17}H_{35}$ | $-CH_2CH_2SO_2CH_2CH(C_8H_{17})(C_6H_{13})$ |
| MC-24 | $C_{17}H_{35}$ | $-CH_2CH_2SO_2C_{12}H_{25}$ |
| MC-25 | $C_{17}H_{35}$ | $-CH_2CH_2CH_2SO_2C_{12}H_{25}$ |
| MC-26 | $C_{17}H_{35}$ | $-CH_2CH_2SO_2CH_2CH(C_2H_5)-C_4H_9$ |

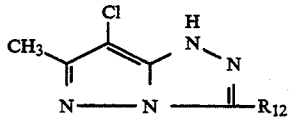

| No. | $R_{12}$ |
|---|---|
| MC-27 | $-C(CH_3)_2-CH_2SO_2C_{12}H_{25}$ |
| MC-28 | $-C(CH_3)_2-CH_2SO_2C_{18}H_{37}$ |
| MC-29 | $-C(CH_3)_2-CH_2SO_2-C_6H_4-NHCOCH(C_{18}H_{35})CH_2COOH$ |
| MC-30 | $-C(CH_3)_2-CH_2SO_2-C_6H_4-NHCOC_{18}H_{37}$ |
| MC-31 | $-C(CH_3)_2-CH_2SO_2-C_6H_3(OC_8H_{17}(t))(OC_4H_9)$ |
| MC-32 | $-CH(CH_3)CH_2SO_2C_{12}H_{25}$ |
| MC-33 | $-CH(CH_3)CH_2SO_2C_{18}H_{37}$ |

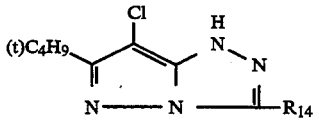

| No. | $R_{14}$ |
|---|---|
| MC-34 | $-CH_2CH_2CH_2SO_2C_{12}H_{25}$ |
| MC-35 | $-CH_2CH_2CH_2SO_2C_{18}H_{37}$ |
| MC-36 | $-CH(CH_3)CH_2SO_2C_{12}H_{25}$ |

-continued
MC-37
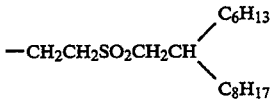
MC-38 $-CH_2CH_2SO_2C_{12}H_{25}$
MC-39
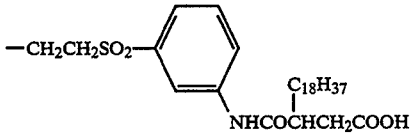
MC-40
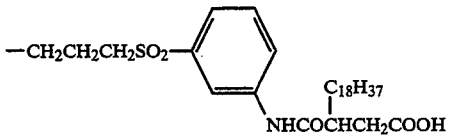
MC-41
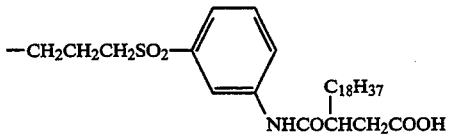
MC-42
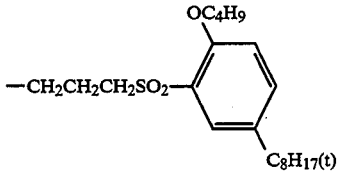
MC-43
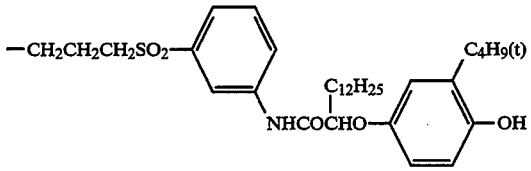
MC-44
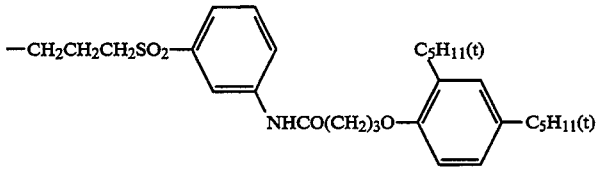
MC-45
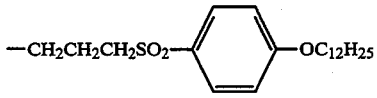
MC-46
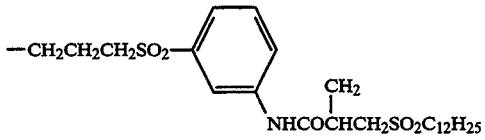
MC-47
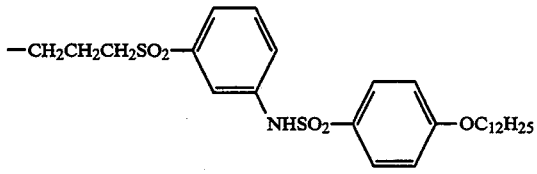

-continued
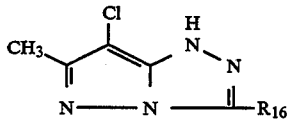
| No. | $R_{16}$ |
|---|---|
| MC-48 | 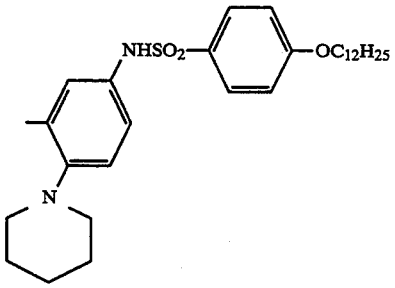 |
| MC-49 | 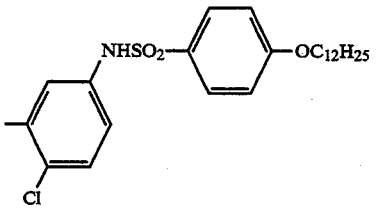 |
| MC-50 | 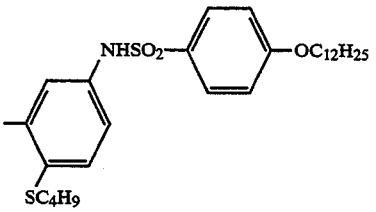 |
| MC-51 | 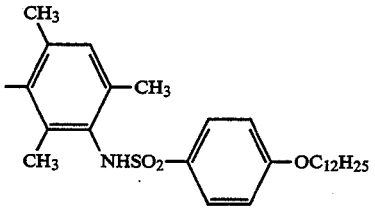 |
| MC-52 | 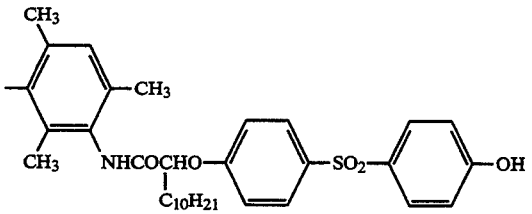 |
| MC-53 | 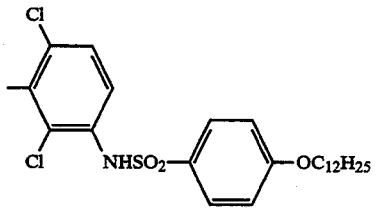 |

-continued
MC-54
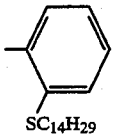
MC-55
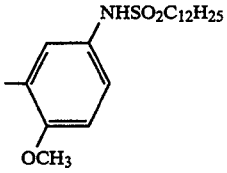
MC-56
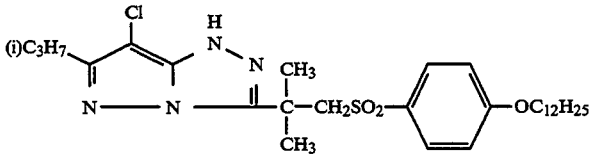
MC-57
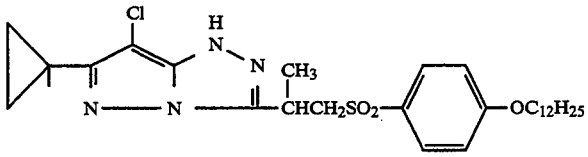
MC-58
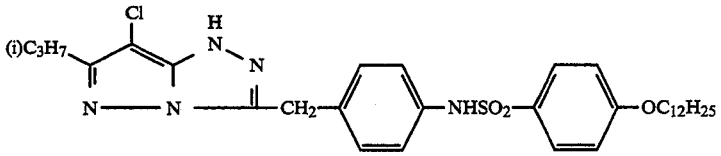
MC-59
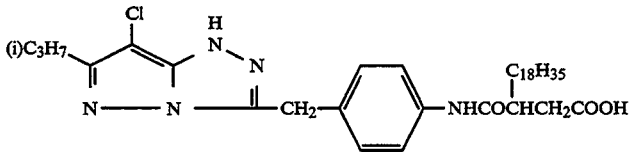
MC-60
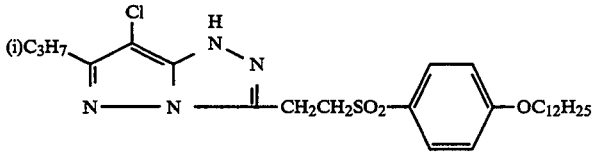
MC-61
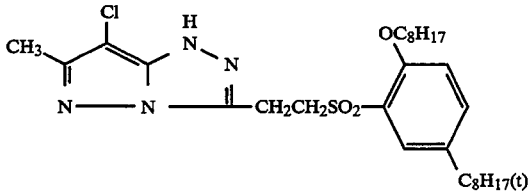
MC-62

-continued
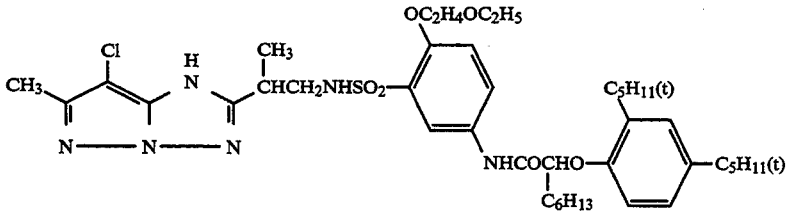
MC-63
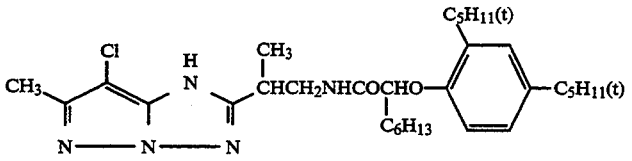
MC-64
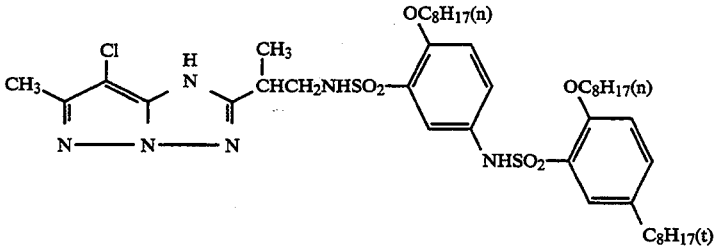
MC-65
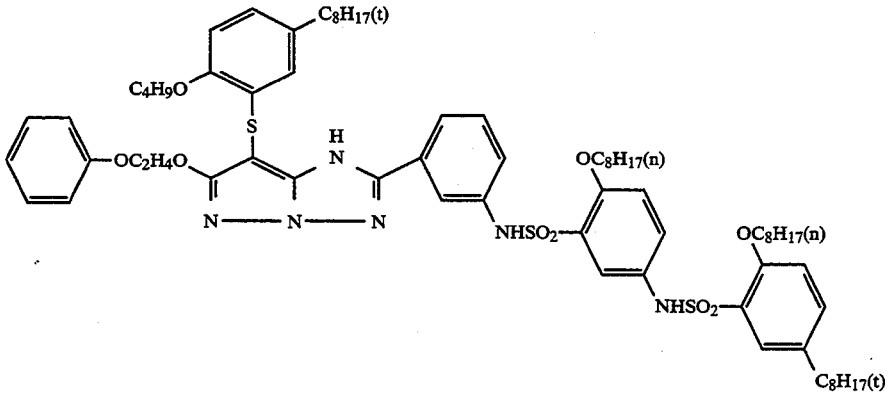
MC-66
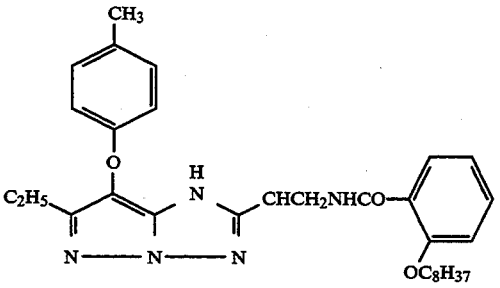
MC-67

-continued

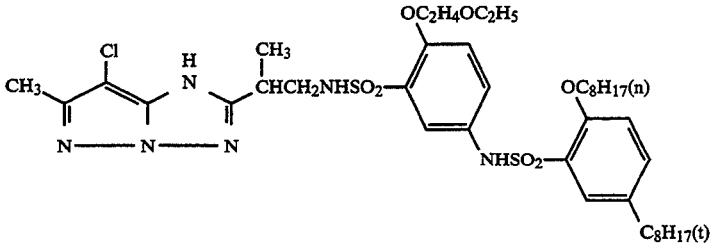

Now, the compounds represented by Formula (A-1) will be detailed.

Formula (A-1)

$R_{21}$—$NHSO_2$—$R_{22}$ wherein $R_{21}$ and $R_{22}$ represent each a hydrogen atom, an alkyl group, a cycloalkyl group, an alkenyl group, a cycloalkenyl group, an alkinyl group, an aryl group, a heterocyclic group, an alkoxy group, an aryloxy group, a heterocyclic-oxy group or a —$N(R_{23})R_{24}$ in which $R_{23}$ and $R_{24}$ represent each a hydrogen atom, an alkyl group or an aryl group, provided, $R_{23}$ and $R_{24}$ may be the same with or the different from each other.

The alkyl groups represented by $R_{21}$ and $R_{22}$ include, for example, those each having 1 to 32 carbon atoms. The alkenyl and alkinyl groups include, for example, those each having 2 to 32 carbon atoms. The cycloalkyl and cycloalkenyl groups include, for example, those each having 3 to 12 carbon atoms, provided wherein the alkyl groups and alkenyl groups may be straight-chained or branched. These groups also include those each having a substituent.

The aryl groups represented by $R_{21}$ and $R_{22}$ include, preferably, a phenyl group including those each having a substituent.

The heterocyclic groups represented by $R_{21}$ and $R_{22}$ include, preferably, a 5- to 7-membered heterocyclic group including those each having a substituent.

The alkoxy groups represented by $R_{21}$ and $R_{22}$ include those each having a substituent, such as, typically, a 2-ethoxyethoxy group, a pentadecyloxy group, a 2-dodecyloxyethoxy group and a phenetyloxyethoxy group.

The aryloxy groups include, preferably, a phenyloxy group of which an aryl nucleus may be substituted. They include, typically, a phenoxy group, a p-t-butylphenoxy group and a m-pentadecylphenoxy group.

The heterocyclic-oxy groups include, preferably, those each having a 5- to 7-membered heterocyclic ring, that may also have a substituent. They include, typically, a 3,4,5,6-tetrahydropyranyl-2-oxy group and a 1-phenyltetrazole-5-oxy group.

Among the compounds of the invention represented by Formula (A-1), the compounds represented by the following Formula (A-3) are particularly preferable.

Formula (A-3)

$R_{25}$—$NHSO_2$—$R_{26}$ wherein $R_{25}$ and $R_{26}$ represent each an alkyl group or an aryl group that also includes those each having a substituent. It is more preferable when at least one of $R_{25}$ and $R_{26}$ represents an aryl group. It is most preferable when $R_{25}$ and $R_{26}$ represent each an aryl group. It is particularly preferable when $R_{25}$ and $R_{26}$ represent each a phenyl group. Inter alia, it is particularly preferable when $R_{25}$ represents a phenyl group and a Hammett's value $\sigma p$ of a para-positioned substituent of a sulfonamido group is not lower than −0.4.

The alkyl and aryl groups represented by $R_{25}$ and $R_{26}$ are synonymous with those represented by $R_{21}$ and $R_{22}$ denoted in Formula (A-1).

In the compounds of the invention represented by Formula (A-1), a polymer of not less than dimer may be formed by $R_{21}$ or $R_{22}$. $R_{21}$ and $R_{22}$ are also allowed to be coupled together so as to form a 5- or 6-membered ring.

The non-color-developable compounds of the invention represented by Formula (A-1) are to have, preferably, not less than 8 carbon atoms in the aggregate and, particularly, not less than 12 carbon atoms.

Now, the typical examples of the compounds of the invention represented by Formula (A-1) will be given below.

| Compound No. | $R_{21}$—$NHSO_2$—$R_{22}$ $R_{21}$ | $R_{22}$ |
|---|---|---|
| A1-1 | 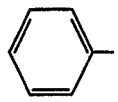 | 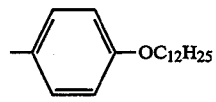 |
| A1-2 | 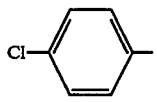 | 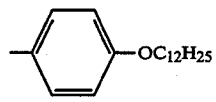 |
| A1-3 | 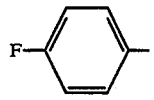 | 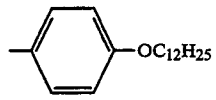 |

-continued
| Compound No. | $R_{21}$—$NHSO_2$—$R_{22}$ $R_{21}$ | $R_{22}$ |
|---|---|---|
| A1-4 | 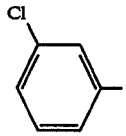 | 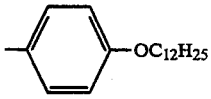 |
| A1-5 | 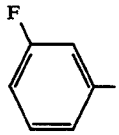 | 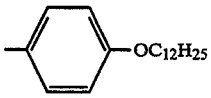 |
| A1-6 | 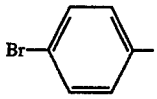 | 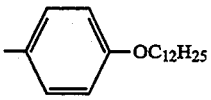 |
| A1-7 | 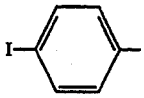 | 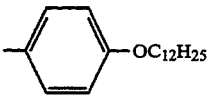 |
| A1-8 | 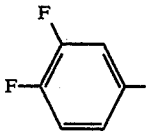 | 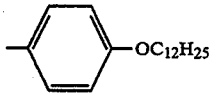 |
| A1-9 | 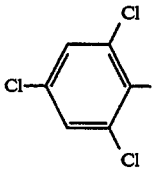 | 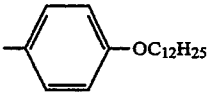 |
| A1-10 | 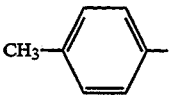 | 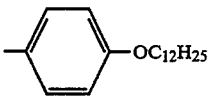 |
| A1-11 | 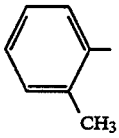 | 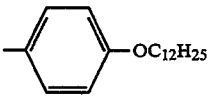 |
| A1-12 | 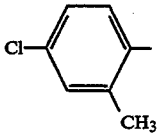 | 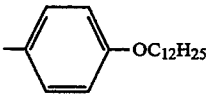 |
| A1-13 | 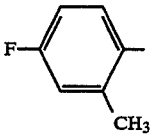 | 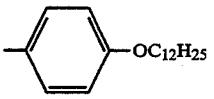 |

-continued
| Compound No. | $R_{21}$—$NHSO_2$—$R_{22}$ $R_{21}$ | $R_{22}$ |
|---|---|---|
| A1-14 | 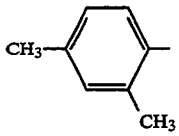 | 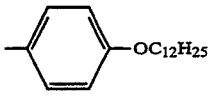 |
| A1-15 | 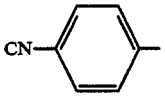 | 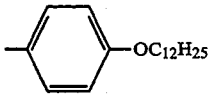 |
| A1-16 | 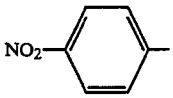 | 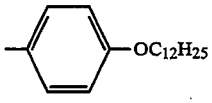 |
| A1-17 | 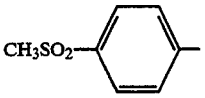 | 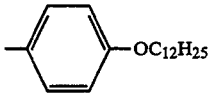 |
| A1-18 | 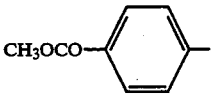 | 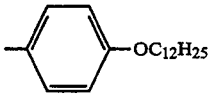 |
| A1-19 | 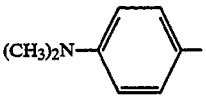 | 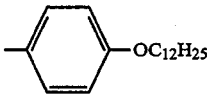 |
| A1-20 | 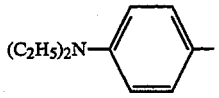 | 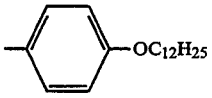 |
| A1-21 | 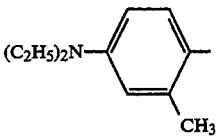 | 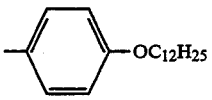 |
| A1-22 | 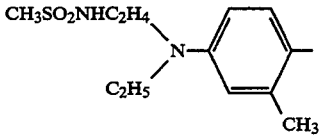 | 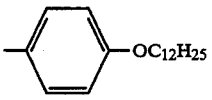 |
| A1-23 | 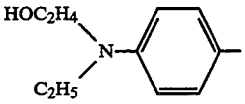 | 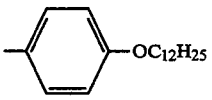 |
| A1-24 | 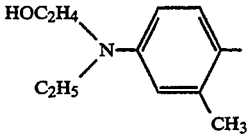 | 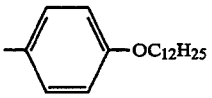 |

-continued
| Compound No. | $R_{21}$—$NHSO_2$—$R_{22}$ $R_{21}$ | $R_{22}$ |
|---|---|---|
| A1-25 | 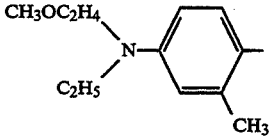 | 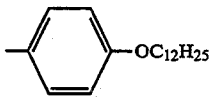 |
| A1-26 | 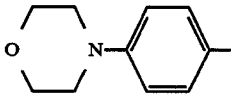 | 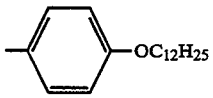 |
| A1-27 | 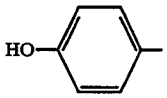 | 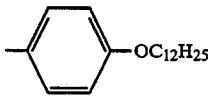 |
| A1-28 | 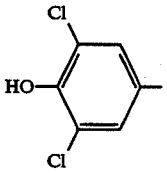 | 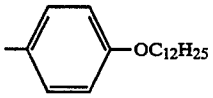 |
| A1-29 | 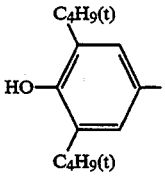 | 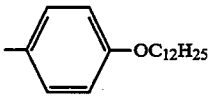 |
| A1-30 | 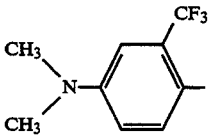 | 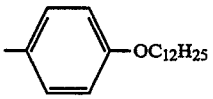 |
| A1-31 | 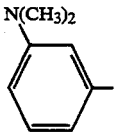 | 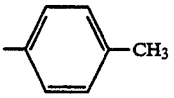 |
| A1-32 | 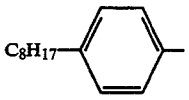 | 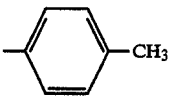 |
| A1-33 | 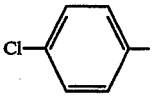 | 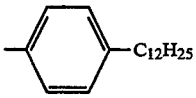 |
| A1-34 | 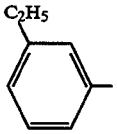 | 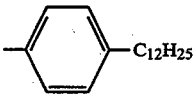 |
| A1-35 | 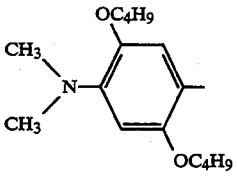 | 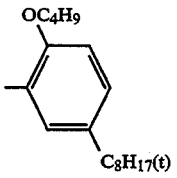 |

-continued
| Compound No. | $R_{21}$—$NHSO_2$—$R_{22}$ $R_{21}$ | $R_{22}$ |
|---|---|---|
| A1-36 | 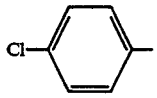 | 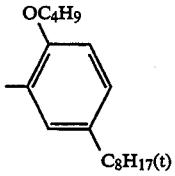 |
| A1-37 | 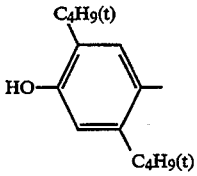 | 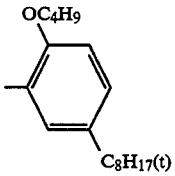 |
| A1-38 | 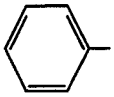 | 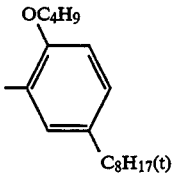 |
| A1-39 | 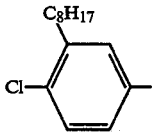 | 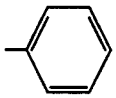 |
| A1-40 | 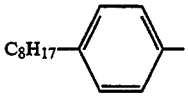 | 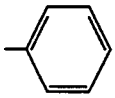 |
| A1-41 | 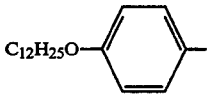 | 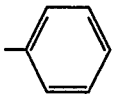 |
| A1-42 | 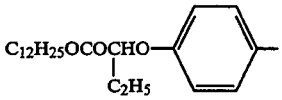 | 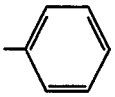 |
| A1-43 | 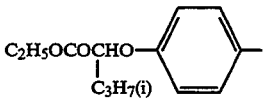 | 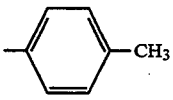 |
| A1-44 | 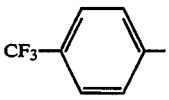 | 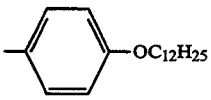 |
| A1-45 | 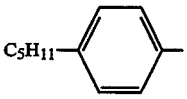 | 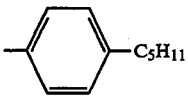 |

-continued

| Compound No. | $R_{21}$—$NHSO_2$—$R_{22}$ $R_{21}$ | $R_{22}$ |
|---|---|---|
| A1-46 | 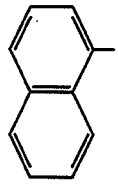 | 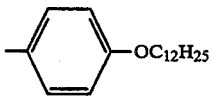 |

The compounds of the invention represented by Formula (A-1) can be synthesized in such a conventionally known process as described in, for example, Japanese Patent Application No. 61-20589/1986.

Now, the compounds represented by Formula (A-2) will be detailed.

Formula (A-2)

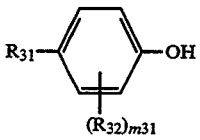

wherein $R_{31}$ represents an alkyl group, an alkoxycarbonyl group, an arylsulfonyl group, an alkylsulfonyl group, an arylsulfonylamino group, an alkylsulfonylamino group, an arylthio group or an alkylthio group; $R_{32}$ represents a group capable of substituting to a benzene ring; and $m_{31}$ is an integer of 0 to 4.

The alkyl groups represented by $R_{31}$ include, preferably, those straight-chained or branched each having 1 to 32 carbon atoms, which also include those each having a substituent. The examples of such an alkyl group as mentioned above include a straight-chained or branched butyl, hexyl, decyl, dodecyl or octadecyl group. Among these alkyl groups represented by $R_{31}$, those each having 4 to 20 carbon atoms are preferable and, inter alia, those each having 5 to 9 carbon atoms are more preferable.

The alkoxycarbonyl groups represented by $R_{31}$ include, preferably, those each having 2 to 20 carbon atoms in the aggregate. The alkyl components of these alkoxycarbonyl groups may be straight-chained or branched and they may also include those each having a substituent. The examples of the alkoxycarbonyl groups include each of the groups of methoxycarbonyl, ethoxycarbonyl, hexyloxycarbonyl, octyloxycarbonyl, undecyloxycarbonyl and octadecyloxycarbonyl. Among these alkoxycarbonyl groups represented by $R_{31}$, those each having 2 to 14 carbon atoms in the aggregate are preferable and, inter alia, those each having 5 to 13 carbon atoms in the aggregate are more preferable.

The arylsulfonyl groups represented by $R_{31}$ include, for example, a benzenesulfonyl group and a naphthalenesulfonyl group, each of which may have a substituent. The typical examples of such an arylsulfonyl groups as mentioned above include a p-toluenesulfonyl group, a p-dodecylbenzenesulfonyl group, a p-dodecyloxybenzenesulfonyl group, a p-chlorobenzenesulfonyl group, a p-octylbenzenesulfonyl group, a 1-naphthalenesulfonyl group and a 4-dodecyloxynaphthalenesulfonyl group.

The alkylsulfonyl groups represented by $R_{31}$ include, for example, those straight-chained or branched each having 1 to 32 carbon atoms, each of which may also have a substituent. The examples of such an alkylsulfonyl groups as mentioned above include a methylsulfonyl group, an ethylsulfonyl group, a straight-chained or branched butylsulfonyl group, a dodecylsulfonyl group and a hexadecylsulfonyl group.

The arylsulfonylamino groups represented by $R_{31}$ include, for example, a benzenesulfonylamino group and a naphthalenesulfonylamino group, each of which may also have a substituent. The typical examples of such an arylsulfonylamino groups include a p-toluenesulfonylamino group, a p-dodecylbenzenesulfonylamino group, a p-dodecyloxybenzenesulfonylamino group, a p-chlorobenzenesulfonylamino group, a p-octylbenzenesulfonylamino group, a 1-naphthalenesulfonylamino group and a 4-dodecyloxynaphthalenesulfonylamino group.

The alkylsulfonylamino groups represented by $R_{31}$ include, preferably, those straight-chained or branched each having 1 to 32 carbon atoms, each of which may also have a substituent. The examples of such an alkylsulfonylamino groups include a methylsulfonylamino group, a dodecylsulfonylamino group and a hexadecylsulfonylamino group.

The arylthio groups represented by $R_{31}$ include, for example, a phenylthio group, a naphthylthio group, a 3-t-butyl-4-hydroxy-5-methylphenyl group and a 4-hydroxyphenyl group.

The alkylthio groups represented by $R_{31}$ include, for example, those straight-chained or branched each having 1 to 32 carbon atoms. Such an alkylthio groups also include those each having a substituent. The typical examples thereof include a butylthio group, a hexylthio group, a dodecylthio group and an octylthio group.

The groups each capable of substituting to a benzene ring, represented by $R_{31}$, shall not specially be limited, but they include, for example, a halogen atom, an alkyl group, a cycloalkyl group, an alkenyl group, a cycloalkenyl group, an alkinyl group, an aryl group, a heterocyclic group, an alkoxy group, an aryloxy group, —$N(R_{33})R_{34}$ (in which $R_{33}$ and $R_{34}$ represent each an alkyl group or an aryl group), a cyano group, an acyl group, an alkoxycarbonyl group, a carbamoyl group, a sulfamoyl group, a nitro group, a carboxyl group, a sulfo group, an alkylthio group, an acylamino group, a sulfonamido group, an arylthio group and a hydroxy group. As for the halogen atoms, a chlorine atoms is particularly preferable.

Now, the typical examples of the non-color-developable compounds of the invention represented by Formula (A-2) will be given below.

A2-1
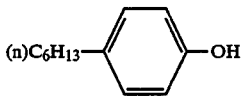
A2-2
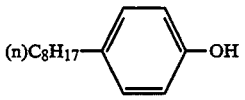
A2-3
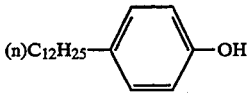
A2-4
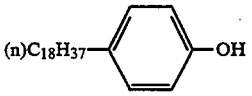
A2-5
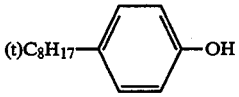
A2-6
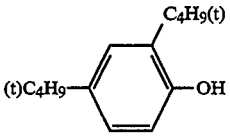
A2-7
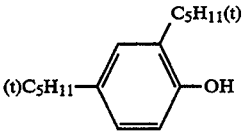
A2-8
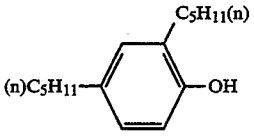
A2-9
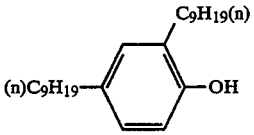
A2-10
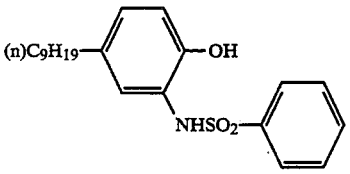
A2-11
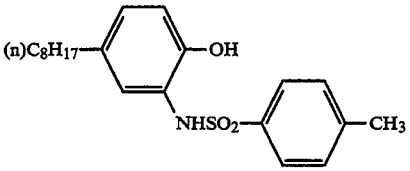
A2-12
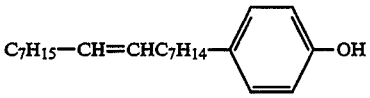
A2-13
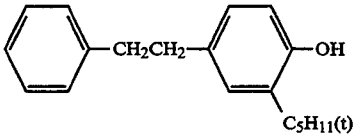
A2-14
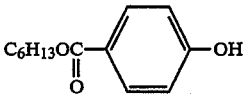
A2-15
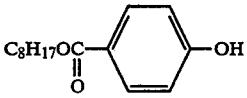
A2-16
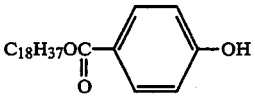
A2-17
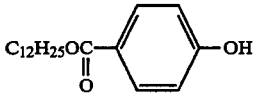
A2-18
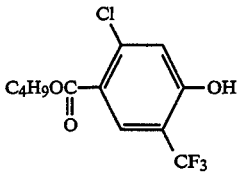
A2-19
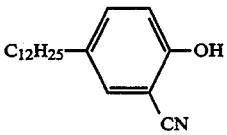
A2-20
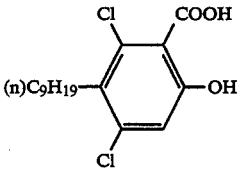

-continued
A2-21
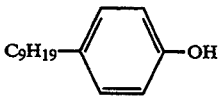
A2-22
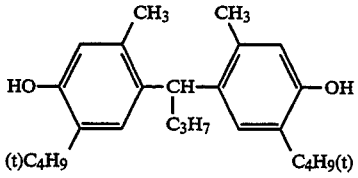
A2-23
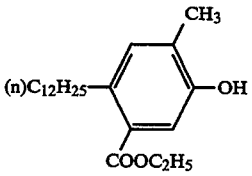
A2-24
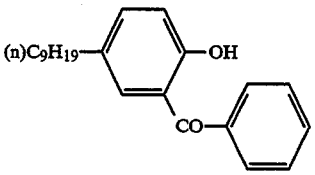
A2-25
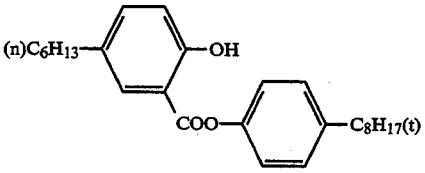
A2-26
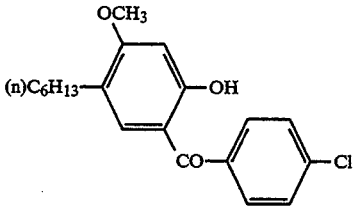
A2-27
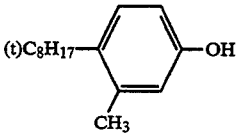
A2-28
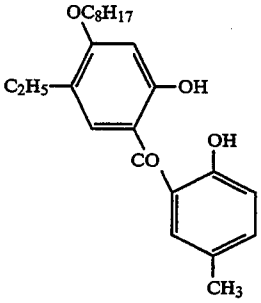
A2-29
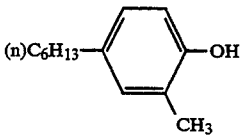
A2-30
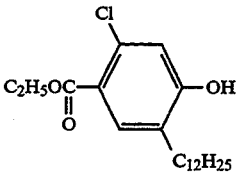
A2-31
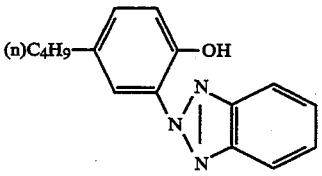
A2-32
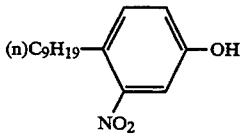
A2-33
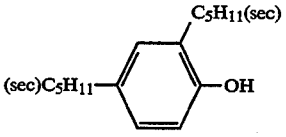
A2-34
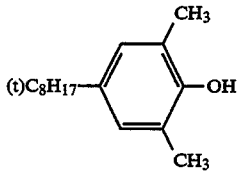
A2-35
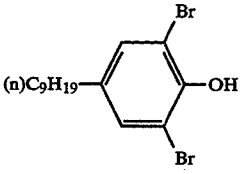
A2-36
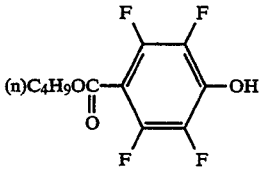

-continued
A2-37
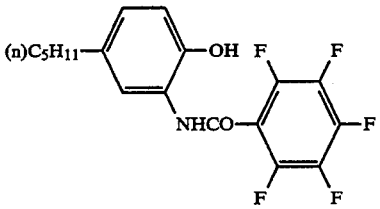
A2-38
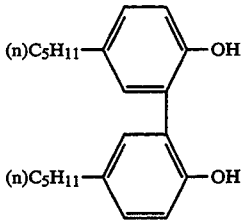
A2-39
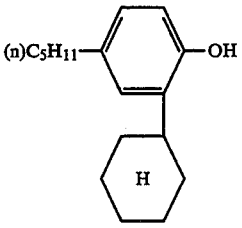
A2-40
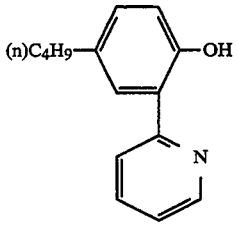
A2-41
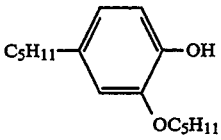
A2-42
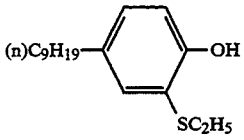
A2-43
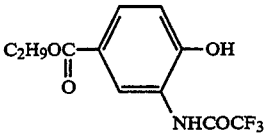
A2-44
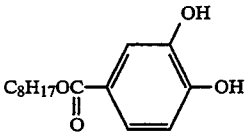
A2-45
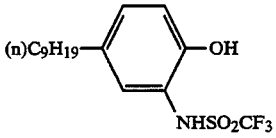
A2-46
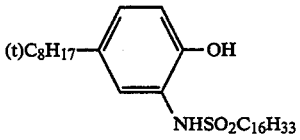
A2-47
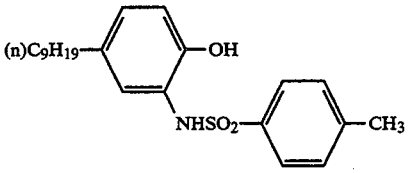
A2-48
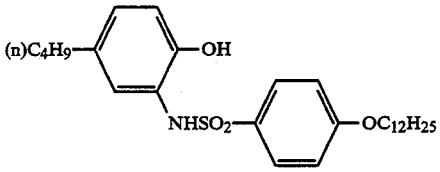
A2-49
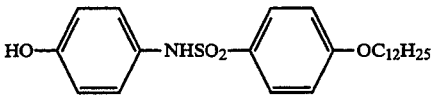
A2-50
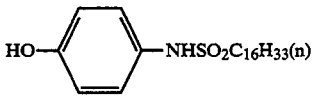
A2-51
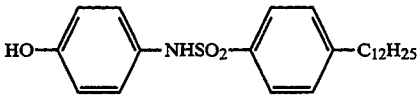
A2-52
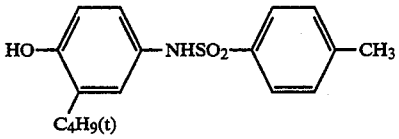
A2-53
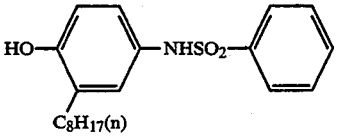
A2-54
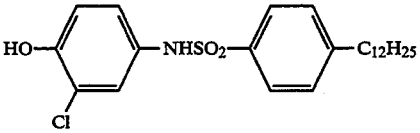

-continued

A2-55

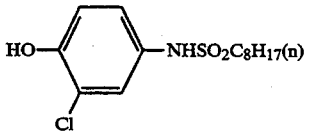

A2-56

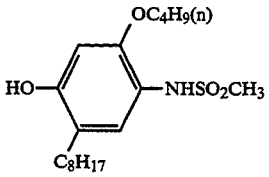

A2-57

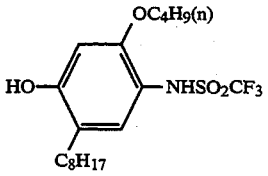

A2-58

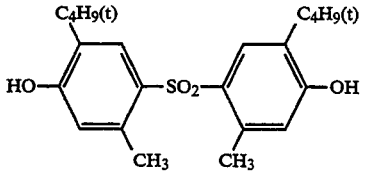

A2-59

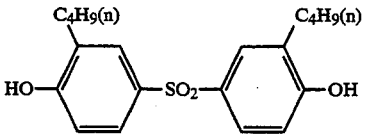

A2-60

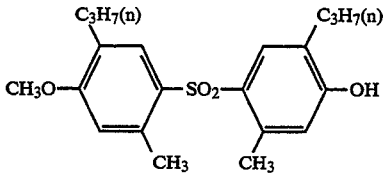

A2-61

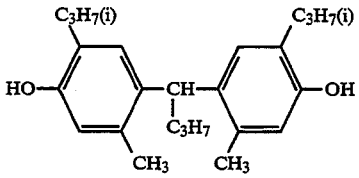

A2-62

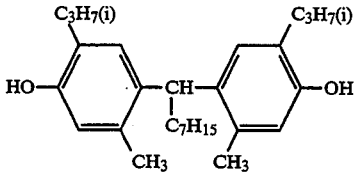

A2-63

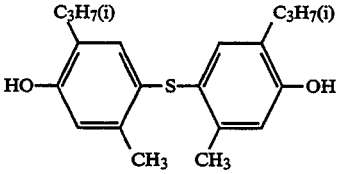

A2-64

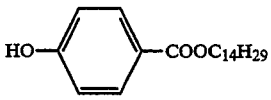

A2-65

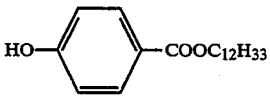

A2-66

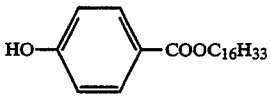

A2-67

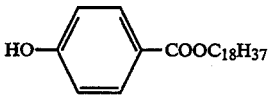

A2-68

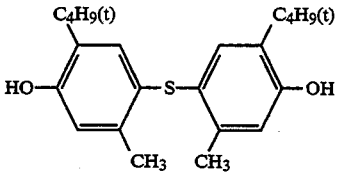

A2-69

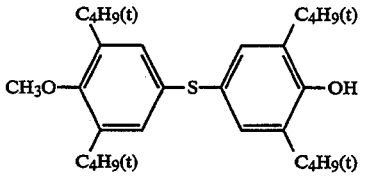

A2-70

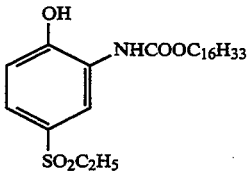

A2-71

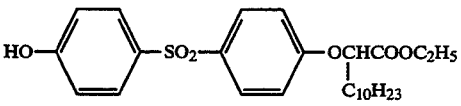

The above-given compounds can readily be synthesized in any conventionally known processes including, for example, the process described in U.S. Pat. No. 2,835,579.

The magenta couplers of the invention represented by Formula (M-I) may be used in an amount within the range of, commonly, $1\times10^{-3}$ mols to $8\times10^{-1}$ mols and, preferably, $1\times10^{-2}$ mols to $8\times10^{-1}$ mols per silver halide used.

The magenta couplers of the invention represented by Formula (M-I) may be used together with other kinds of magenta couplers in combination.

In the invention, a high boiling solvent represented by Formula (A-1) or (A-2) may be added in an amount within the range of, preferably, 0.01 to 10 g per g of a magenta coupler of the invention represented by Formula (M-I) and, more preferably, 0.1 to 3.0 g.

In the invention, the high boiling solvents represented by Formula (A-1) or (A-2) may be used in combination, and they may also be used with other kinds of high boiling solvents in combination.

For containing a magenta coupler of the invention represented by Formula (M-I) in a photographic emulsion, any conventional processes may be adopted. For example, a magenta coupler of the invention is dissolved independently or in combination in either a mixed solution containing a high boiling solvent and a low boiling solvent such as butyl acetate and ethyl acetate or a solvent containing only a low boiling solvent. Then, the resulting solution is mixed with an aqueous gelatin solution containing a surfactant. Thereafter, the resulting mixture thereof is emulsified and dispersed by making use of a high-speed rotary mixer, a colloid-mill or a supersonic dispersing machine. Finally, the resulting dispersion thereof is directly added to a subject photographic emulsion. Or, the magenta coupler thereof may be added into a subject emulsion, after the above-mentioned emulsified dispersion is set, finely cut apart and washed.

A magenta coupler of the invention represented by Formula (M-I) may also be added to a silver halide emulsion by dispersing it separately from a high boiling solvent in the above-mentioned dispersing process. However, it is preferable to make use a process in which the both compounds are dissolved together at the same time and the resulting solution is dispersed and, then, the dispersion thereof is added to the silver halide emulsion.

As for a silver halide emulsion applicable to a light-sensitive material of the invention, any ordinary silver halide emulsions may be used. Such an emulsion as mentioned above may be chemically sensitized in an ordinary process, and it may also optically sensitized to any desired wavelength region, by making use of a sensitizing dye.

To such a silver halide emulsion as mentioned-above, an antifoggant, a stabilizer and so forth may also be added. As for a binder for the emulsions, gelatin can advantageously be used.

Emulsion layers and other hydrophilic colloidal layers may each be hardened and they may also contain a plasticizer and a water-insoluble or hardly water-soluble synthetic polymer dispersion (that is so-called a latex). In an emulsion layer of a color photographic light-sensitive material, a coupler is used.

It is further allowed to use the following compounds therein. For example, a colored coupler having a color-correction effect, a competing coupler and a compound capable of releasing a photographically useful fragment including a development accelerator, a bleach accelerator, a development agent, a silver halide solvent, a color toner, a layer hardener, a foggant, an antifoggant, a chemical sensitizer, a spectral sensitizer and a desensitizer.

As for a support, a sheet of paper laminated with polyethylene or the like, a polyethylene terephthalate paper, a baryta paper. a cellulose triacetate paper and so forth may be used.

When making use of a light-sensitive material of the invention, a dye image can be obtained by exposing it to light and then treating it in a commonly known color photographic process.

The invention is applicable to a color negative film, a color paper, a color reversal film and so forth.

EXAMPLE

A typical example of the invention will now be detailed. However, the embodiments of the invention shall not be limited thereto.

Example 1

On a triacetyl cellulose film support, each of the layers having the following composition was formed in order, so that multilayered color photographic light-sensitive material Nos. 1 through 19 could be prepared.

Every amount of the components added to a multilayered color photographic light-sensitive material will be indicated by grams per sq.meter, unless otherwise expressly stated, except that the amounts of silver halide and colloidal silver were indicated in terms of the silver contents thereof and that the amounts of sensitizing dyes were indicated by the mol numbers thereof per mol of silver.

| | |
|---|---|
| Layer 1: An antihalation layer (HC) | |
| Black colloidal silver | 0.15 |
| UV absorbent (UV-1) | 0.20 |
| Colored cyan coupler (CC-1) | 0.02 |
| High boiling solvent (Oil-1) | 0.20 |
| High boiling solvent (Oil-2) | 0.20 |
| Gelatin | 1.6 |
| Layer 2: An interlayer (IL-1) | |
| Gelatin | 1.3 |
| Layer 3: A low-speed red-sensitive emulsion layer (RL) | |
| Silver iodobromide emulsion (Em-1) | 0.4 |
| Silver iodobromide emulsion (Em-2) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (DD-1) | 0.01 |
| High boiling solvent (Oil-1) | 0.55 |
| Gelatin | 1.0 |
| Layer 4: A high-speed red-sensitive emulsion layer (RH) | |
| Silver iodobromide emulsion (Em-3) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (DD-1) | 0.02 |
| High boiling solvent (Oil-1) | 0.25 |
| Gelatin | 1.0 |
| Layer 5: An interlayer (IL-2) | |
| Gelatin | 0.8 |
| Layer 6: A low-speed green-sensitive emulsion layer (GL) | |
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 10^{-4}$ |
| Magenta coupler (See Table-1) | 0.47 |
| Colored magenta coupler (CM-1) | 0.10 |
| DIR compound (DD-3) | 0.02 |
| High boiling solvent (See Table-1) | 0.70 |
| Gelatin | 1.0 |
| Layer 7: A high-speed green-sensitive emulsion layer | |

-continued

| | |
|---|---|
| (GH) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (See Table-1) | 0.20 |
| Colored magenta coupler (CM-1) | 0.04 |
| DIR compound (DD-3) | 0.01 |
| High boiling solvent (See Table-1) | 0.35 |
| Gelatin | 1.0 |
| Layer 8: A yellow filter layer (YC) | |
| Yellow colloidal silver | 0.1 |
| Additive (SC-1) | 0.12 |
| High boiling solvent (Oil-2) | 0.15 |
| Gelatin | 1.0 |
| Layer 9: A low-speed blue-sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-1) | 0.60 |
| Yellow coupler (Y-2) | 0.32 |
| DIR compound (DD-2) | 0.01 |
| High boiling solvent (Oil-2) | 0.18 |
| Gelatin | 1.3 |
| Layer 10: A high-speed blue-sensitive emulsion layer (BH) | |
| Silver iodobromide emulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High boiling solvent (Oil-2) | 0.05 |
| Gelatin | 1.0 |
| Layer 11: Protective layer 1 (PRO-1) | |
| Silver iodobromide emulsion (Em-5) | 0.3 |
| UV absorbent (UV-1) | 0.07 |
| uv absorbent (UV-2) | 0.1 |
| Formalin scavenger (HS-1) | 0.5 |
| Formalin scavenger (HS-2) | 0.2 |

-continued

| | |
|---|---|
| High boiling solvent (Oil-1) | 0.07 |
| High boiling solvent (Oil-3) | 0.07 |
| Gelatin | 0.8 |
| Layer 12: Protective layer 2 (PRO-2) | |
| Alkali-soluble matting agent, (having an average particle size of 2 μm) | 0.13 |
| Polymethyl methacrylate, (having an average particle size of 3 μm) | 0.02 |
| Gelatin | 0.5 |

Further, besides the above-given components, coating aid SU-2, dispersing aid SU-1, layer hardener H-1, and dyes AI-1 and AI-2 were appropriately added to each of the layers.

The following emulsions were used in the above-mentioned samples. Every emulsion used therein was an internally high iodine-containing, monodisperse type emulsion having a distribution range of 14%.

Em-1 : Average silver iodide content: 7.5 mol % Average gain size: 0.55 μm Grain configuration: Octahedron Em-2 : Average silver iodide content: 2.5 mol % Average gain size: 0.36 μm Grain configuration.: Octahedron Em-3 : Average silver iodide content: 8.0 mol % Average gain size: 0.84 μm Grain configuration: Octahedron Em-4 : Average silver iodide content: 8.5 mol % Average gain size: 1.02 μm Grain configuration: Octahedron Em-5 : Average silver iodide content: 2.0 mol % Average gain size: 0.08 μm Grain configuration: Octahedron

C-1

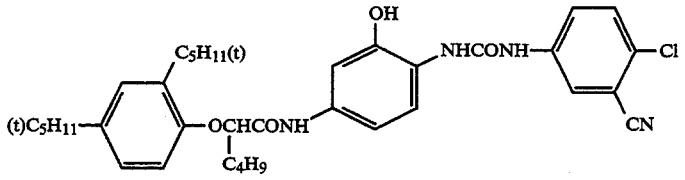

C-2

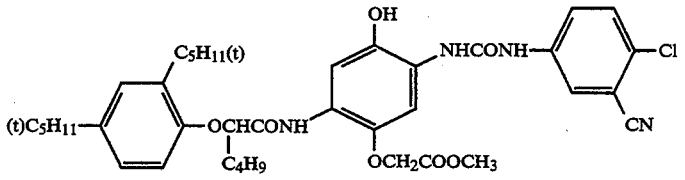

M-A (Comparative coupler)

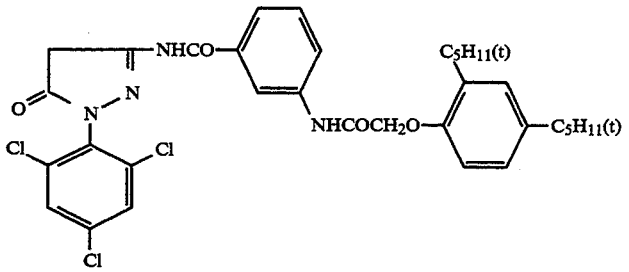

CM-1

-continued
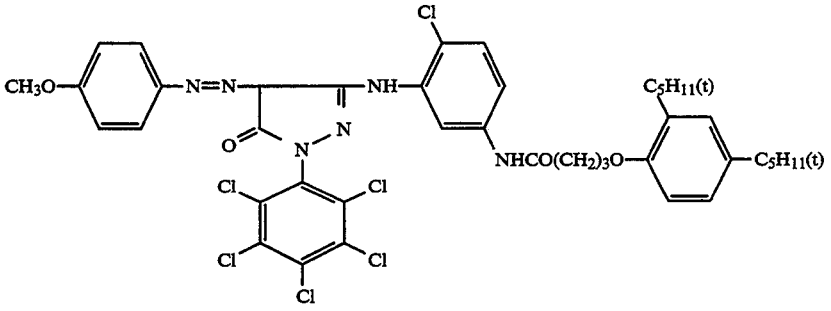
Y-1
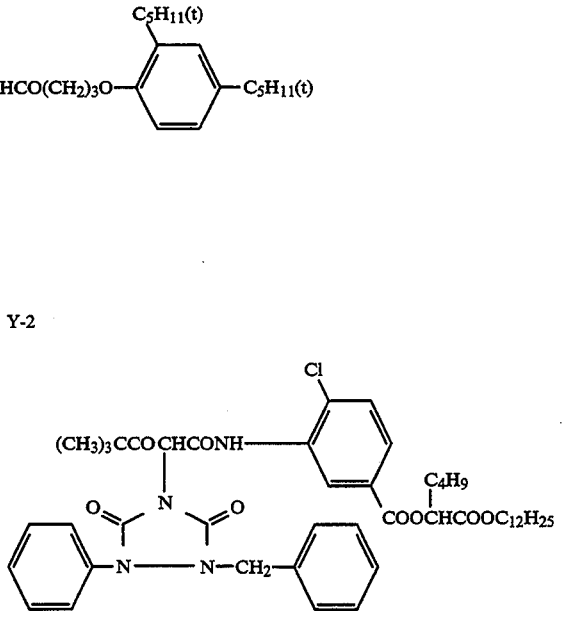
Y-2
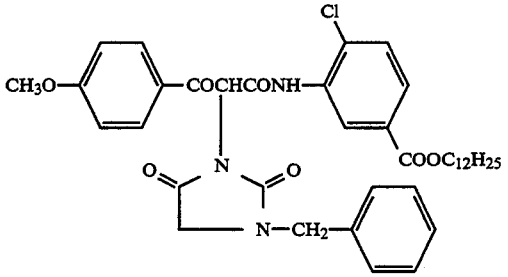
CC-1
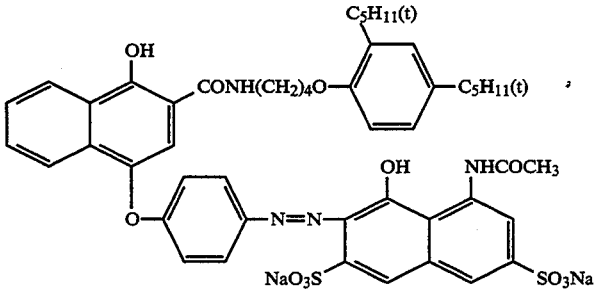
DD-1
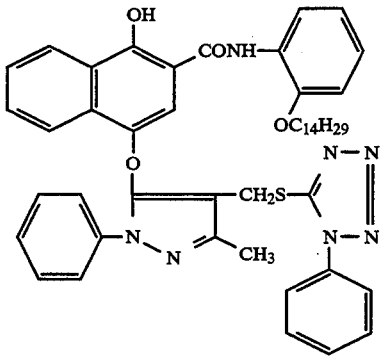
DD-2
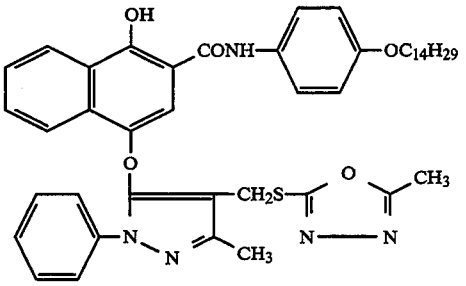
DD-3
UV-1

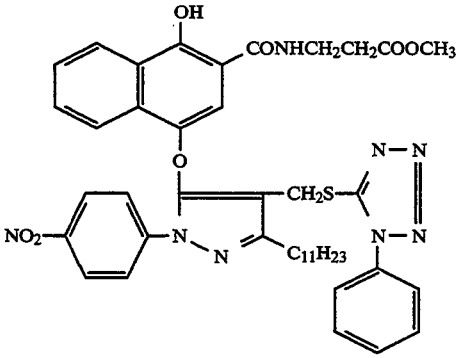
UV-2
-continued
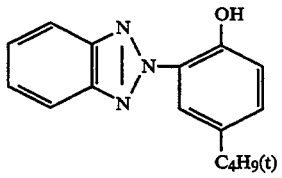
S-1
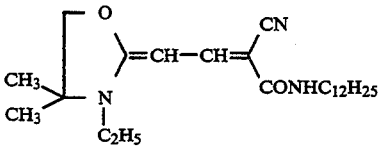
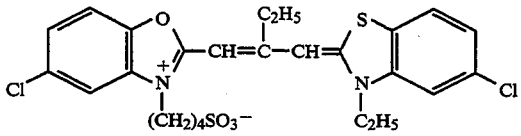
S-2
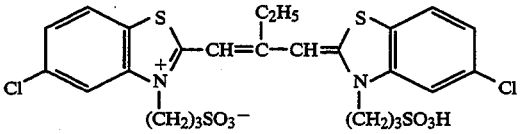
S-3
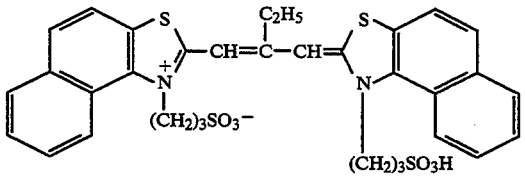
S-4
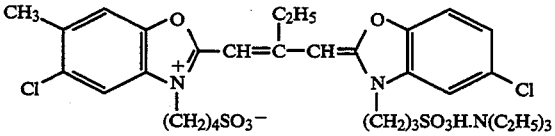
S-5
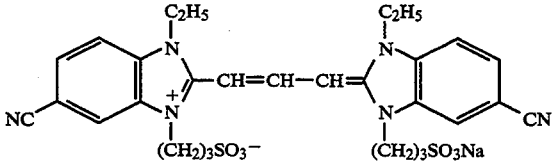
S-6
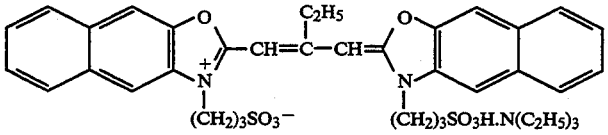
S-7
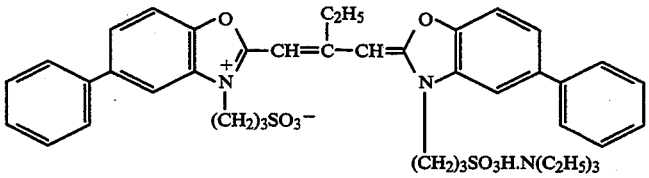
S-8
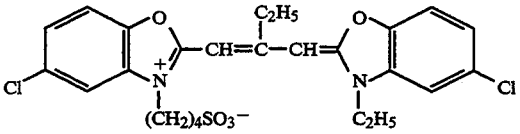
S-9
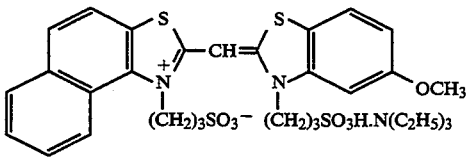
S-10
S-11

-continued

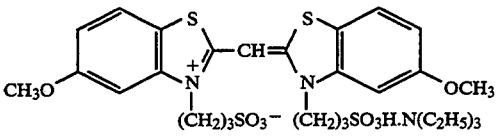

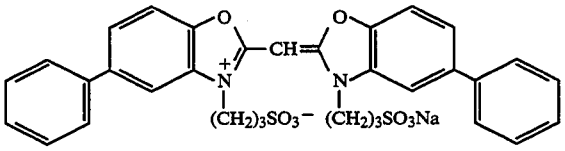

AI-1

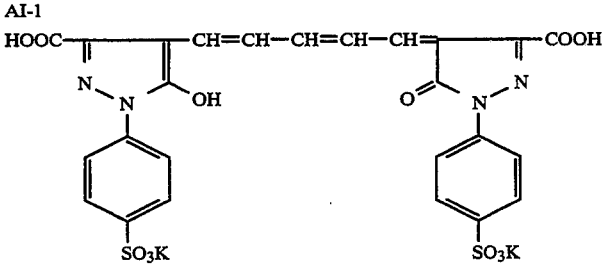

AI-2

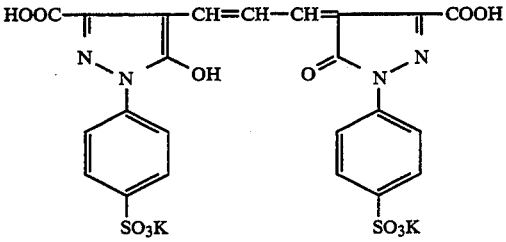

SU-1

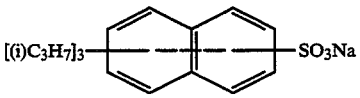

SU-2

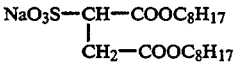

SC-1

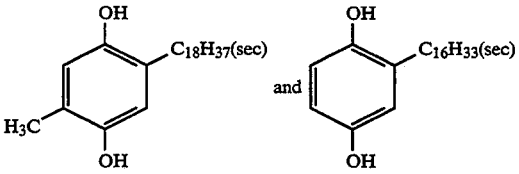

(A mixture having a proportion of 2:3)

Oil-1

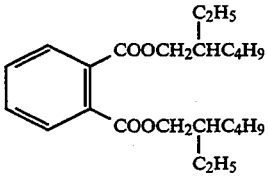

Oil-2

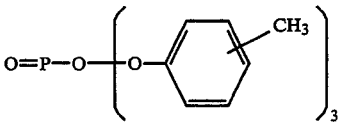

Oil-3

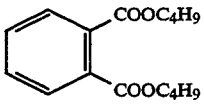

H-1

$CH_2{=}CHSO_2CH_2OCH_2SO_2CH{=}CH_2$

HS-1

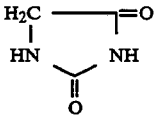

HS-2

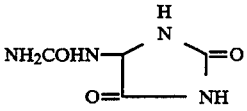

The resulting samples No. 1 through No. 19 were each exposed to white light through a sensitometric step-wedge and were then processed in the following processing steps.

| Processing steps (at 38° C.) | Processing time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

-continued

| Processing steps (at 38° C.) | Processing time |
|---|---|
| Drying | |

The composition of the processing solutions used in the processing steps were as follows.

| | |
|---|---|
| <Color developing solution> | |
| 4-amino-3-methyl-N-ethyl-N-(β-hydroxyethyl) aniline sulfate | 4.75 g |
| Sodium sulfite, anhydrous | 4.25 g |
| Hydroxylamine ½ sulfate | 2.0 g |
| Potassium carbonate, anhydrous | 37.5 g |
| Sodium bromide | 1.3 g |
| Trisodium nitrilotriacetate, (monohydrate) | 2.5 g |
| Potassium hydroxide | 1.0 g |
| Add water to make | 1 liter |
| Adjust pH to be | pH =10.05 |
| <Bleaching solution> | |
| Iron (III) ammonium ethylenediamine tetraacetate | 100.0 g |
| Diammonium ethylenediamine tetraacetate | 10.0 g |
| Ammonium bromide | 150.0 g |
| Glacial acetic acid | 10.0 ml |
| Add water to make | 1 liter |
| Adjust pH with aqueous ammonia to be | pH =6.0 |
| <Fixing solution> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH =6.0 |
| <Stabilizing solution> | |
| Formalin (in an aqueous 37% solution) | 1.5 ml |
| Konidux (manufactured by Konica Corp.) | 7.5 ml |
| Add water to make | 1 liter |

The resulting samples No. 1 through No. 19 were each processed in accordance with the above-mentioned color processing steps. On each of the color images produced thereon, the sensitivity (that was the reciprocal of an exposure quantity necessary to give a density of the minimum density+0.1) produced on the green-sensitive emulsion layer of each sample was measured by making use of an optical densitometer (Model PDA-65 manufactured by Konica Corp.). The sensitivities shown in Table-1 are indicated by a value relative to the sensitivity obtained from Sample No. 1, which was regarded as a standard value of 100.

Next, on the D-log E characteristic curve of the green density of each sample, the inclination (γ1) from the point of density 1.0 to the density point of Δ log E=1.0 on the side of the highly exposed region and the inclination (γ2) from the point of density 2.0 to the density point of Δ log E=1.0 on the side of the highly exposed region were each obtained. Thereafter, each of the samples was processed in quite the same manner as in the foregoing processing steps (hereinafter referred to as Process B), except that the pH of the color developing solution used in the foregoing processing steps was changed into pH=10.2, and the inclinations (γ1) and (γ2) were each obtained in the same manner as above and, further, the difference between the values Δ γ1 and Δ γ2 each obtained in Processes A and B were obtained. It is herein indicated that the processing variations were reduced when the values of Δ γ1 and Δ γ2 were each small.

After aging Samples No. 1 through No. 19 to at a high temperature and a high humidity (at 50° C. and 80% RH) for 3 days, they were exposed wedgewise to light and then color developed. On each of the developed samples, the sensitivity of the green-sensitive layer thereof was measured and the difference between the sensitivities (Δ log E) obtained from each of the pre-aged and aged samples were obtained.

The results thereof will be shown in Table-1.

TABLE 1

| | Layers 6 and 7 | | | | | | |
|---|---|---|---|---|---|---|---|
| Sample No. | Coupler used | High boiling solvent | Sensitivity | pH processing variation γ1 | pH processing variation γ2 | Raw stock preservability ΔlogE | Remarks |
| 1 | M-A | oil-2 | 100 | 0.04 | 0.04 | −0.07 | Comparison |
| 2 | M-A | A1-1 | 101 | 0.04 | 0.04 | −0.08 | Comparison |
| 3 | MC-1 | A1-1 | 209 | 0.03 | 0.02 | −0.02 | Invention |
| 4 | MC-1 | A2-68 | 210 | 0.02 | 0.03 | −0.03 | Invention |
| 5 | MC-1 | A1-1 A2-68 | 220 | 0.02 | 0.03 | −0.02 | Invention |
| 6 | MC-9 | A1-26 | 209 | 0.03 | 0.03 | −0.02 | Invention |
| 7 | Mc-19 | A2-65 | 210 | 0.02 | 0.03 | −0.02 | Invention |
| 8 | MC-28 | A1-22 | 208 | 0.02 | 0.02 | −0.02 | Invention |
| 9 | MC-28 | A2-17 | 210 | 0.02 | 0.03 | −0.03 | Ivention |
| 10 | MC-28 | A1-1 A2-68 | 219 | 0.02 | 0.03 | −0.03 | Invention |
| 11 | MC-28 | A1-1 A2-22 | 216 | 0.02 | 0.03 | −0.02 | Invention |
| 12 | MC-29 | A1-32 | 210 | 0.02 | 0.02 | −0.03 | Invention |
| 13 | MC-31 | A2-71 | 210 | 0.02 | 0.03 | −0.02 | Invention |
| 14 | MC-36 | A2-70 | 201 | 0.04 | 0.04 | −0.03 | Invention |
| 15 | MC-40 | A2-67 | 202 | 0.04 | 0.03 | −0.03 | Invention |
| 16 | MC-41 | A1-38 | 202 | 0.03 | 0.04 | −0.03 | Invention |
| 17 | MC-48 | A1-49 | 210 | 0.03 | 0.03 | −0.03 | Invention |
| 18 | MC-48 | A2-58 | 211 | 0.03 | 0.03 | −0.02 | Invention |
| 19 | MC-60 | A2-59 | 198 | 0.04 | 0.04 | −0.04 | Invention |

As is obvious from Table-1, it was proved that, in Sample No. 1 applied with a comparative coupler and a comparative high boiling solvent and in Sample No. 2 applied with a comparative coupler and an inventive high boiling solvent, the sensitivities thereof were relatively lower and the sensitivities thereof were seriously lowered under the conditions of a high temperature and a high humidity. In contrast to the above, it is proved from Samples No. 3 through No. 19 each applied with a coupler of the invention that a high sensitivity could be displayed, that the sensitivity was almost nothing to be lowered under the conditions of a high temperature and a high humidity and that a processing variations could be reduced.

What is claimed is:

1. A silver halide color photographic light-sensitive material comprising a support having provided thereon, a blue-sensitive silver halide emulsion layer, a green-sensitive silver halide emulsion layer, and a red-sensitive silver halide emulsion layer, wherein said green-sensitive silver halide emulsion layer contains at least one coupler represented by a formula selected from the group consisting of Formulas (M-IX), (M-X), (M-XI) and (M-XII); and at least one non-color-forming compound represented by Formula A-1;

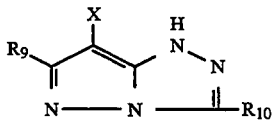

Formula (M-IX)

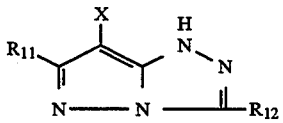

Formula (M-X)

-continued

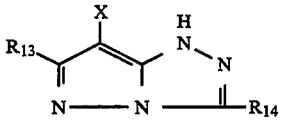

Formula (M-XI)

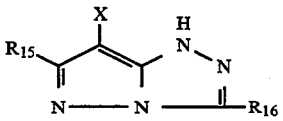

Formula (M-XII)

wherein, $R_9$ represents primary alkyl having a total of not less than 2 carbon atoms, $R_{10}$ represents a substituent, $R_{11}$ represents hydrogen or a substituent; $R_{12}$ represents secondary or tertiary branched alkyl, $R_{13}$ represents tertiary alkyl; $R_{14}$ represents a substituent, $R_{15}$ represents hydrogen or a substituent; $R_{16}$ represents aryl, X represents hydrogen or a substituent capable of splitting off upon reaction with an oxidized product of a color developing agent:

Formula (A-1)

$R_{21}$—$NHSO_2$—$R_{22}$ wherein $R_{21}$ and $R_{22}$ each independently represent aryl.

2. The material of claim 1 wherein said compound represented by Formula A-1 is added in an amount of 0.01 to 10 g per g of said magenta coupler.

* * * * *